United States Patent [19]

Lee et al.

[11] 4,370,141

[45] Jan. 25, 1983

[54] PROCESS FOR THE THERMAL STABILIZATION OF ACRYLIC FIBERS

[75] Inventors: Shu M. Lee, Madison, N.J.; Donald M. Gezovich, Louisville, Ky.

[73] Assignee: Celanese Corporation, New York, N.Y.

[21] Appl. No.: 264,741

[22] Filed: May 18, 1981

[51] Int. Cl.[3] ..... C01B 31/07

[52] U.S. Cl. ..... 8/115.5; 264/25; 264/29.2; 423/447.4

[58] Field of Search ..... 423/447.4; 264/29.2, 264/25; 8/115.5

[56] References Cited

U.S. PATENT DOCUMENTS 3,523,345 8/1970 Hughes ..... 264/168
3,699,210 10/1972 Binning et al. ..... 264/29.2

FOREIGN PATENT DOCUMENTS 1945145 3/1970 Fed. Rep. of Germany .
1241937 8/1971 United Kingdom .

*Primary Examiner*—Jay H. Woo
*Attorney, Agent, or Firm*—Burns, Doane, Swecker & Mathis

[57] ABSTRACT

An improved process is provided whereby acrylic fibers are thermally stabilized (i.e., rendered black in appearance and non-burning when subjected to an ordinary match flame). The acrylic fibrous material, while present in an oxygen-containing atmosphere, is subjected to the intermittent irradiation of a laser beam which surprisingly has been found to expedite the desired thermal stabilization when compared to commonly employed processes which transfer heat to the acrylic fibers primarily by the convective flow of a heated gas (e.g., air) while the acrylic fibers are suspended in a hot gas oven. In a preferred embodiment the laser beam is produced by the use of a $CO_2$ infrared laser.

21 Claims, 2 Drawing Figures

PROCESS FOR THE THERMAL STABILIZATION OF ACRYLIC FIBERS

BACKGROUND OF THE INVENTION

It is well known that acrylic fibrous materials when subjected to heat undergo a thermal stabilization reaction wherein the fibrous material is transformed to a black form which is non-burning when subjected to an ordinary match flame.

Such modification generally has been accomplished by heating the acrylic fibrous material in an oxygen-containing atmosphere. It is believed that the resulting thermal stabilization reaction involves (1) an oxidative cross-linking reaction of adjoining molecules, (2) a cyclization reaction of pendant nitrile groups to a condensed dihydropyridine structure, and (3) a dehydrogenation reaction. The cyclization reaction is exothermic in nature and must be controlled if the fibrous configuration of the acrylic polymer undergoing stabilization is to be preserved. The thermal stabilization reaction heretofore has generally been believed to be diffusion controlled and to require considerable time for oxygen to enter the interior portions of the fiber.

On a commercial scale the thermal stabilization reaction commonly is carried out on a continuous basis with a continuous length of a multifilament acrylic fibrous material being passed in the direction of its length through a thermal stabilization zone which is provided with a heated gaseous atmosphere. The movement of the continuous length of acrylic fibrous material through the stabilization zone containing the heated gaseous atmosphere may be directed by rollers situated therein. Additionally, it has been proposed to internally heat the rollers which contact the acrylic fibrous material.

Representative United States patents which concern the thermal stabilization of an acrylic fibrous material include: U.S. Pat. Nos. 3,285,696; 3,539,295; 3,699,210; 3,826,611; 3,961,888; 4,186,179; and Reissue No. 30,414. Since the thermal stabilization reaction has tended to be unduly time consuming various routes have been proposed to expedite the desired reaction through some form of catalysis and/or chemical modification of the acrylic fibrous precursors. See, for instance, the following U.S. Pat. Nos. which are representative of this approach: 3,592,595; 3,650,668; 3,656,882; 3,656,883; 3,708,326; 3,729,549; 3,813,219; 3,820,951; 3,850,876; 3,923,950, 4,002,426; and 4,004,053.

The resulting acrylic fibrous materials can be used in the formation of non-burning fabrics. Alternatively, the stabilized acrylic fibrous materials can be used as precursors in processes for the formation of carbon or graphitic carbon fibers. U.S. Pat. Nos. 3,775,520 and 3,954,950 disclose representative overall processes for forming carbon fibers beginning with an acrylic precursor.

There has remained a need for a simple expeditious process for the formation of thermally stabilized acrylic fibrous materials. Such need is particularly acute in the overall context of carbon fiber production since the carbonization or carbonization and graphitization portions of the overall process commonly require a considerably lesser residence time than the initial thermal stabilization portion of the process. Accordingly, heretofore it has been essential to provide extremely large ovens in order to accomodate the acrylic fibrous material undergoing thermal stabilization if the entire process is carried out on a continuous basis with the fibrous material passing directly from the stabilization zone to the carbonization zone.

It has heretofore been proposed that a previously stabilized acrylic fibrous material may be carbonized and/or graphitized in a laser beam while present in a non-oxidizing atmosphere. See, for instance, U.S. Pat. No. 3,699,210; British Pat. No. 1,241,937; and German Offenlegungsschrift No. 1,945,145.

It is an object of the present invention to provide an improved process for the thermal stabilization of acrylic fibrous materials.

It is an object of the present invention to provide an improved process for the thermal stabilization of an acrylic fibrous material which surprisingly can be carried out on an expeditious basis, and which requires a lesser residence time than prior art processes wherein heat is transferred to the acrylic fibrous material primarily by convection.

It is an object of the present invention to provide an improved process for the thermal stabilization of an acrylic fibrous material which can be carried out without the excessive usage of energy as commonly required in the prior art.

It is an object of the present invention to provide a simple improved process for the thermal stabilization of an acrylic fibrous material which does not require the heating of the gaseous atmosphere surrounding the acrylic fibrous material.

It is an object of the present invention to provide an improved process for the thermal stabilization of an acrylic fibrous material wherein oxygen readily enters the interior of the acrylic fibrous material without any substantial formation of a diffusion limiting skin on the outer surfaces of the fibers during the course of the thermal stabilization reaction.

It is another object of the present invention to provide an efficient process for the stabilization of an acrylic fibrous material immediately prior to the carbonization or carbonization and graphitization of the same.

It is a further object of the present invention to provide an improved thermal stabilization process wherein the fibers are intermittently heated without the necessity that the fibers contact heated surfaces such as heated rollers which possibly may cause damage to the same.

These and other objects of the invention, as well as its scope, nature, and utilization will be apparent to those skilled in the art from the following detailed description and appended claims.

SUMMARY OF THE INVENTION

It has been found that in a process for the thermal stabilization of an acrylic fibrous material selected from the group consisting of an acrylonitrile homopolymer and an acrylonitrile copolymer containing at least 85 mole percent acrylonitrile units and up to 15 mole percent of one or more monovinyl units copolymerized therewith wherein the acrylic fibrous material is heated in an oxygen-containing atmosphere while retaining the original fibrous configuration substantially intact and the acrylic fibrous material is rendered black in appearance and non-burning when subjected to an ordinary match flame; that an improvement results when at least a portion of the heating of the acrylic fibrous material is accomplished by the intermittent irradiation of the acrylic fibrous material with a laser beam.

DESCRIPTION OF PREFERRED EMBODIMENTS

Figure 1:
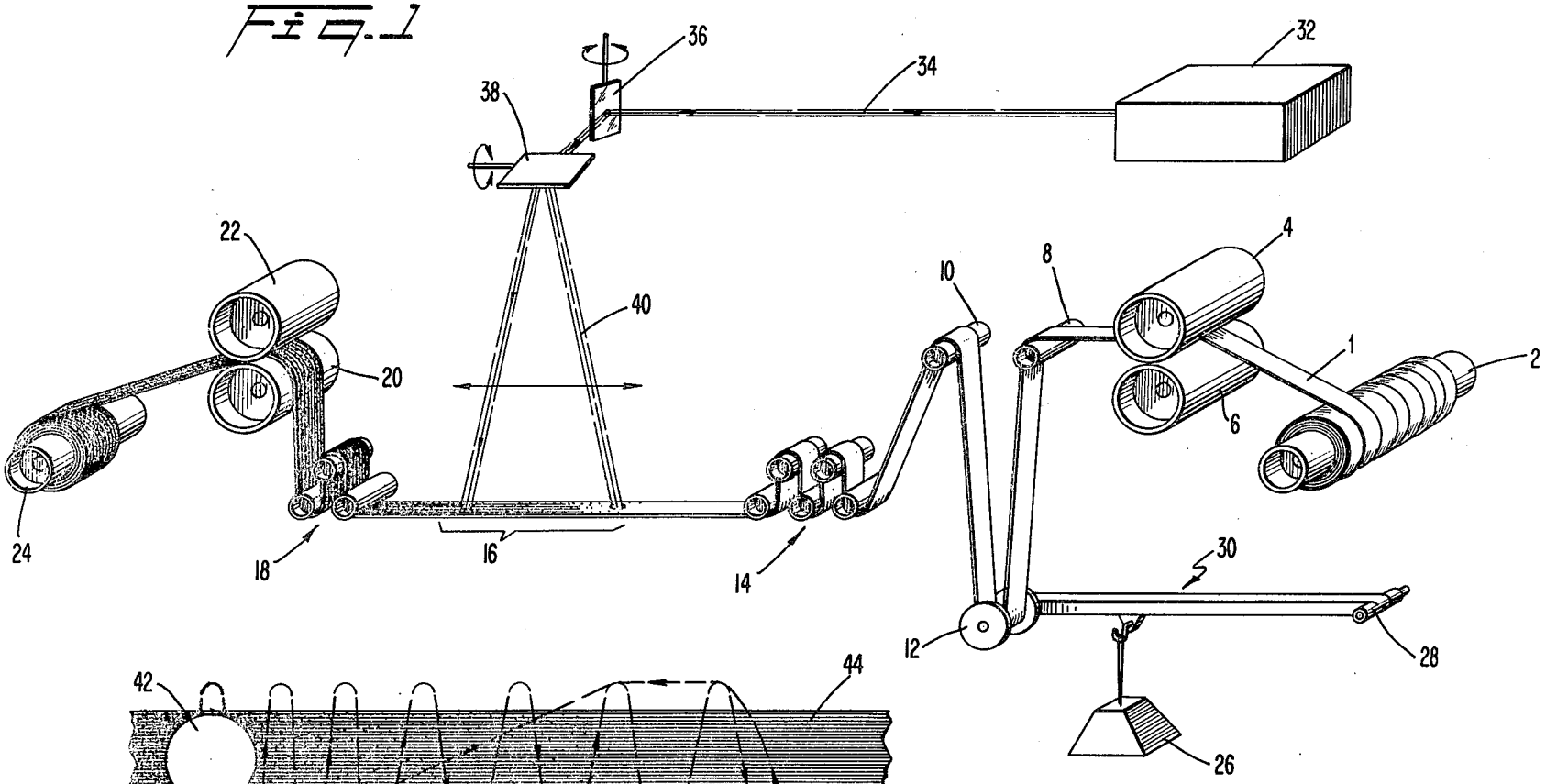
FIG. 1 is a perspective view of a preferred apparatus arrangement for carrying out the process of the present invention wherein a continuous length of a multifilamentary tow of an acrylic precursor is continuously passed in the direction of its length under a laser beam which is raster scanned over the tow by the oscillation of a pair of orthogonal mirrors in a predetermined pattern to yield the intermittent irradiation of a given area of the acrylic tow.

The acrylic fibrous material which is thermally stabilized in accordance with the process of the present invention may be present in any one of a variety of physical configurations. For instance, the fibrous material may be present in the form of continuous single filaments, staple fibers, tows, yarns, tapes, knits, braids, fabrics, or other fibrous assemblages. In a preferred embodiment of the invention the acrylic fibrous material is present as a continuous length of multifilamentary material, e.g., a multifilamentary yarn or tow. In a particularly preferred embodiment the acrylic fibrous material is in the form of a flat tow having a relatively thin thickness (e.g., 0.5 to 1.5 mm.). If the tow is too thick then the inner fibers will tend to be unduly shielded by the outer fibers. Alternatively, if the tow thickness is too thin and the filaments non-contiguous, then insufficient mass may be presented for efficient adsorption of the energy provided by the laser beam.

The acrylic fibrous material which serves as the starting material may be prepared by conventional techniques which are well known to those skilled in the art. For instance, dry spinning or wet spinning techniques may be employed. The denier of the acrylic fibrous material may be varied. In a preferred embodiment the acrylic fibrous material possesses a denier per filament of approximately 0.5 to 1.6 (e.g., 0.9) immediately prior to the thermal stabilization treatment. However, since the process of the present invention does not appear to be diffusion controlled, fibrous precursors of a considerably larger denier may be selected.

The acrylic fibrous material which serves as the starting material is either an acrylonitrile homopolymer or an acrylonitrile copolymer which contains at least 85 mole percent of acrylonitrile and up to 15 mole percent of one or more monovinyl units copolymerized therewith. Preferred acrylonitrile copolymers contain at least 95 mole percent of acrylonitrile units and up to 5 mole percent of one or more monovinyl units copolymerized therewith. Such monovinyl units may be derived from styrene, methyl acrylate, methyl methacrylate, vinyl acetate, vinyl chloride, vinylidene chloride, vinyl pyridine, etc. In a particularly preferred embodiment the acrylonitrile copolymer comprises 98 mole percent acrylonitrile units and 2 mole percent methyl acrylate units.

During the thermal stabilization treatment of the present invention the acrylic fibrous material is heated in an oxygen-containing atmosphere by intermittent irradiation with a laser beam whereby the acrylic fibrous material is rendered black in appearance and non-burning when subjected to an ordinary match flame while retaining the original fibrous configuration substantially intact. The acrylic fibrous material may be moving or stationary at the time of the irradiation. It surprisingly has been found that heating produced by irradiation with a laser beam will enable the desired thermal stabilization to be accomplished in a highly expeditious manner.

The molecular oxygen-containing gaseous atmosphere in which the thermal stabilization reaction is carried out preferably is air. Alternatively, substantially pure oxygen or other oxygen-containing atmospheres may be selected. In a preferred embodiment the oxygen-containing atmosphere is simple air which is provided at ambient conditions (e.g., room temperature of approximately 25° C.). Alternatively, a portion of the heating of the acrylic fibrous material may be accomplished by the laser irradiation and a portion of the heating by contact with a conventionally heated oxygen-containing atmosphere wherein heat is transferred to fibrous material to at least some degree by convective heating. Additionally, it is possible that at least a portion of the heating be imparted by heated rollers or other heated surfaces with which the fibrous material comes in contact. In a particularly preferred embodiment substantially all of the heating of the acrylic fibrous material is accomplished by irradiation with the laser beam. In all embodiments of the process of the present invention the thermal stabilization of the acrylic fibrous material is carried out more expeditiously than in a process wherein heat is transferred to the acrylic fibrous material primarily by convection while the fibers are suspended throughout the entire thermal stabilization treatment in a hot gas oven.

When carrying out the process of the present invention, a laser is selected which is capable of yielding the desired heating as described hereafter. As will be apparent to those skilled in the art, lasers are recognized sources of intense collimated beams of electromagnetic energy that is converted to heat only upon absorption by a target area. The laser beam may be focused with precision to irradiate the acrylic fibrous material. Accordingly, significant energy savings are made possible by the process of the present invention since the heating is confined substantially to the acrylic fibrous material as it is irradiated by the laser beam. Insulation requirements are reduced and heat need not be lost through the heating of oven walls, rollers, a large volume of an oxygen-containing gas, etc.

In a preferred embodiment of the process the laser radiation is produced by a $CO_2$ infrared laser. The size of the laser selected obviously will be influenced to at least some degree by the dimensions of the acrylic fibrous material undergoing thermal stabilization. When thermally stabilizing a flat tow of approximately 6000 acrylic filaments having a width of approximately one centimeter, particularly good results have been achieved when using a 50 Watt $CO_2$ infrared laser, Model 42, manufactured by the Coherent Radiation Co. of Palo Alto, Calif. Representative other laser types which are capable of producing the desired laser beam are CO lasers, HF lasers, etc.

The intermittent irradiation of the acrylic fibrous material may be accomplished by a variety of techniques as will be apparent to those skilled in laser technology. For instance, the intermittent irradiation may be accomplished by pulsing the laser beam and/or the relative movement of the laser beam with respect to the acrylic fibrous material. The intermittent nature of the irradiation makes it possible not to exceed the critical level of irradiation which would destroy the fibrous precursor. In all instances the level of irradiation imparted to the acrylic fibrous material is adjusted to that required to produce the desired heating without exceeding the temperature at which the original fibrous material is destroyed.

Pulsing of the laser beam may be accomplished by standard techniques such as by gating the power supply, using a diffraction grid for the laser beam, chopping the laser beam, Q-switching the laser beam, using electro-optical modulators, etc. The power density, pulse duration, and pulse repetition rates are adjusted so as to yield the desired thermal stabilization reaction while retaining the original fibrous configuration substantially intact. Representative pulse conditions when employing the 50 Watt $CO_2$ infrared laser, Model 42, manufactured by the Coherent Radiation Co. are power densities over the target area of approximately 1.5 to 2.2 W./cm.$^2$, pulse durations of approximately 10 to 400 milliseconds, and pulse repetition rates of approximately 2 to 30 pulses per second.

The relative movement of the laser beam and the acrylic fibrous material so as to produce the desired intermittent irradiation can be accomplished in a variety of ways as will be apparent to those skilled in laser technology. As previously indicated in a preferred embodiment a continuous length of the acrylic fibrous material is continuously moved through the laser beam which contributes to some degree the creation of the desired intermittent contact. However, such intermittent laser irradiation may be accomplished solely or largely by the continuous and repeated movement of the beam over the acrylic fibrous material even if no pulsing of the beam is employed. A beam pattern preferably is selected so that all portions of the acrylic fibrous material receive substantially uniform irradiation. For instance, the laser beam may be rapidly directed in a predetermined pattern by a pair of oscillating orthogonal mirrors. In this manner the laser beam may be raster scanned in a predetermined substantially uniform pattern such as that of a Lissajous figure. The number of horizontal nodes in the Lissajous figure may be varied widely and is primarily dependent upon the dimensions of the fiber area chosen to be irradiated (e.g., 3 to 20 horizontal nodes, or more). In a preferred embodiment wherein the 50 Watt $CO_2$ infrared laser, Model 42, is operated at a continuous power density of 1.7 W./cm.$^2$, the beam having a diameter of approximately 0.65 cm. may be caused to traverse a seven node Lissajous figure having a maximum horizontal dimension of approximately 5 cm. and a maximum vertical dimension of approximately $1\frac{1}{2}$ cm. approximately 5 to 10 cycles per second (e.g., 8 Hz.).

In a preferred embodiment the acrylic fibrous material is provided as a continuous length of multifilamentary material when undergoing the thermal stabilization reaction and is provided under a constant longitudinal tension. For instance, the tension can be selected so as to accomodate approximately 0 to 20 percent longitudinal shrinkage during the thermal stabilization treatment in the absence of any substantial filament breakage. The rollers which feed and withdraw the acrylic fibrious material to and from the zone in which the laser irradiation takes place may be driven at the same rate and a constant tension applied to the continuous length of fibrous material. Alternatively, the ends of an acrylic fibrous material which is stationary at the time of the laser irradiation may be fixed or otherwise secured so as to restrain undue shrinkage, or a weight may be secured to one end of the fibers to provide a constant tension.

The temperature of acrylic fibrous material during the course of the thermal stabilization treatment may be monitored by the use of a remote sensing low temperature range fast responding optical pyrometer. For instance, satisfactory results have been obtained through the use of a fast response optical pyrometer having a time constant of 0.1 second manufactured by the Williamson Corporation of Concord, Massachusetts, Model 4210S-C-FOV3-FR. When employing such equipment it has been found that in a preferred embodiment the acrylic fibrous material is heated to a time average temperature of approximately 200° to 250° C. while being subjected to the intermittent irradiation of the laser beam. It is, of course, essential that any maximum temperature experienced by the acrylic fibrous material upon direct irradiation not exceed the temperature at which the original fibrous configuration is destroyed. If sufficiently brief such maximum temperature may be as high as approximately 310° C. for many acrylic fibrous materials. Such maximum temperature which can be endured without deleterious results will vary with the chemical composition of the acrylic fibrous material and the ability of the heat to be promptly dissipated when the laser beam is removed prior to the next intermittent contact with the laser beam. It has been found that when the acrylic fibrous material is a thin tow of filaments composed of 98 mole percent of acrylonitrile units and 2 mole percent methyl acrylate units, then the original fibrous material often is destroyed if the time average temperature of the same much exceeds 250° C. Particularly satisfactory results with such fibrous material have been achieved while employing a time average temperature of approximately 230° C.

The process of the present invention provides an extremely rapid technique to thermally stabilize an acrylic fibrous material when compared to prior art processes wherein the heat is imparted to the fibers by other means such as standard convective heating. It has been found, for instance, that the desired thermal stabilization may be accomplished within approximately 5 to 20 minutes while being subjected to the intermittent irradiation. At the conclusion of the thermal stabilization reaction the fibrous material is black in appearance and non-burning when subjected to an ordinary match flame.

It has been found when a cross-section of the stabilized acrylic fibrous material is subjected to optical or scanning electron microscopy that the interior portions of the fibers are uniformly black in appearance in spite of the relatively brief nature of thermal stabilization treatment. Additionally, when the stabilized fibers are subjected to differential scanning calorimetry analysis (DSC) the usual exotherm commonly exhibited upon the heating of non-thermally stabilized acrylic fibers is substantially eliminated. Such stabilized acrylic fibers contain about 62 to 66 percent carbon by weight. When the stabilized acrylic fibers are analyzed for bound oxygen content employing the Unterzaucher analysis, bound oxygen values of at least 6 percent by weight have been observed.

The process of the present invention is highly flexible and offers significant advantages when compared to acrylic fiber stabilization processes of the prior art. It has been found that the desired thermal stabilization may be accomplished at an extremely rapid rate when the heat is imparted to the acrylic fibers upon irradiation with the laser beam. Such rapid reaction rate readily facilitates the coupling of the thermal stabilization reaction with that of a carbonization or carbonization and graphitization step if carbon fibers are intended to be the final product. Additionally, it surprisingly has been found when the heating is accomplished by use of the laser beam that oxygen readily enters the interior of the acrylic fibrous material without any substantial formation of a diffusion limiting skin on the outer surfaces of the fibers during the course of the thermal stabilization reaction. Such absence of a fiber skin/core can be confirmed by optical or scanning electron microscopy of fiber cross-sections at intermediate times during the thermal stabilization treatment. The process further offers the advantage of low energy consumption since it is the fiber present within the laser target area and not the environment which is heated. Accordingly, the power density delivered to the fiber by the laser is significantly greater than that of an oven drawing the same amount of electricity.

Non-burning fabrics may be formed from the resulting stabilized acrylic fibrous material. Alternatively, the stabilized acrylic fibrous material may be used as a fibrous precursor for the formation of carbon fibers (i.e., of either amorphous or graphitic carbon). Such carbon fibers contain at least 90 percent carbon by weight (e.g., at least 95 percent carbon by weight) and may be formed by heating the previously stabilized acrylic fibers at a temperature of at least approximately 900° C. in a non-oxidizing atmosphere (e.g., nitrogen, argon, etc.) in accordance with techniques well known in the art.

The following Examples are presented as specific illustrations of the claimed process. It should be understood, however, that the invention is not limited to the specific details of the examples.

EXAMPLE I

The acrylic fibrous material selected for thermal stabilization was a continuous length of a tow consisting of approximately 6000 substantially parallel filaments of 0.9 denier per filament. The filaments had been formed by wet spinning and were composed of approximately 98 mole percent acrylonitrile units and 2 mole percent methyl acrylate units.

With reference to FIG. 1 the tow of acrylic fibrous material 1 which had not previously undergone a thermal stabilization treatment was provided on supply roll 2. The tow 1 was continuously withdrawn from supply roll 2 by the driven rotation of a pair of feed or pinch rolls 4 and 6 which were provided with a rubber surface to grip the tow of acrylic fibrous material as it passed between them. The tow next passed over a pair of idler rolls 8 and 10 and intermediate idler roll 12. From idler roll 10 the tow was passed to a series of five additional idler rolls 14 which served to flatten the tow to a relatively constant width of approximately 1 cm. and a relatively thin thickness of approximately 1 mm. Following passage through thermal stabilization zone 16 the tow passed over a series of three idler rolls 18 and then between a pair of driven take-up or pinch rolls 20 and 22 which were also provided with a rubber surface to grip the tow of stabilized acrylic fibrous material as it passed between them. The tow of stabilized acrylic fibrous material was collected on roll 24.

The tow of the acrylic fibrous material was passed through thermal stabilization zone 16 at a rate of 1 cm./155 seconds. The rate of passage of the tow through the thermal stabilization zone was controlled by the speed of rotation of rolls 4, 6, 20 and 22. A constant tension of approximately 0.1 gram per denier was maintained on the fibrous material by means of intermediate idler roll 12, and a 1.4 kilogram weight 26 which was attached to pivot mechanism 28 of dancer arm 30. Air at ambient temperature (i.e., approximately 25° C.) surrounded the apparatus arrangement of FIG. 1.

The laser 32 employed was a 50 Watt $CO_2$ infrared laser, Model 42, manufactured by the Coherent Radiation Co. The laser 32 was operated at a continuous power density of 2.1 W./cm.$^2$ and produced a circular beam of radiation 34 having a diameter of 0.65 cm. which was directed to a pair of rapidly oscillating orthogonal mirrors 36 and 38. From mirror 38 the beam 40 was directed to the acrylic fibrous material undergoing thermal stabilization. The mirrors were Model No. PAFG X-Y purchased from the Bulova Corporation. Mirror 36 oscillated in a substantially vertical plane and mirror 38 oscillated in a substantially horizontal plane.

Figure 2:
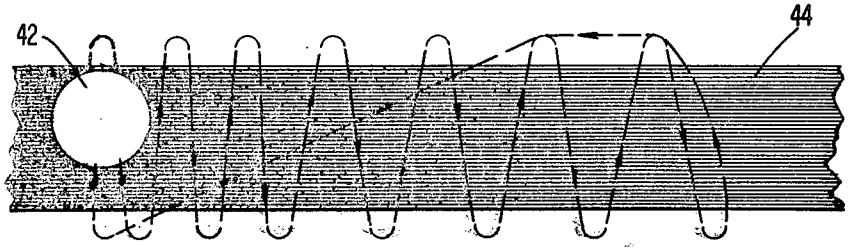
FIG. 2 illustrates the irradiation pattern produced when using the apparatus arrangement of FIG. 1.

As illustrated in FIG. 2, the oscillation of mirrors 36 and 38 caused the circular laser beam 42 to irradiate the continuously moving flattened tow 44 of acrylic fibrous material in a Lissajous figure shown generally by the broken lines having seven nodes. Such Lissajous figure had a maximum horizontal dimension of approximately 5 cm. and a maximum vertical dimension of approximately 1½ cm. The laser beam raster scanned the complete Lissajous figure at a rate of 8 cycles per second.

The fibrous material was present in thermal stabilization zone 16 of FIG. 1 for a residence time of 12.9 minutes. The laser beam was in actual contact with a given area of the fibrous material for approximately 0.5 minute of this residence time. The time average temperature of the fibrous material while present in thermal stabilization zone 16 was found to be 230° C. when tested with a fast response optical pyrometer having a time constant of 0.1 second manufactured by the Williamson Corporation, Model 4210S-C-FOV3-FR. The optical pyrometer was directed to the center of zone 16 during the course of this temperature measurement.

The resulting fibrous product retained its original fibrous material intact, was black in appearance, was non-burning when subjected to an ordinary match flame, was substantially free of residual exotherm when subjected to differential scanning calorimetry analysis, and possessed a bound oxygen content of approximately 6 percent by weight when subjected to the Unterzaucher analysis.

EXAMPLE II

Another thermal stabilization process embodiment was carried out similar to that of Example I with the exception that the flat tow of acrylic fibrous material was stationary when thermally stabilized, and the laser beam was pulsed by gating the power supply without raster scanning. More specifically, the laser beam had a diameter of 1.5 inches and was operated at a power density of 1.5 W./cm.$^2$, a pulse duration of 100 milliseconds, and a pulse repetition rate of 6 pulses per second. The residence time in the thermal stabilization zone was 20 minutes, and the time average temperature of the fibrous material while present in the thermal stabilization zone was believed to be approximately 225° C.

when tested with the optical pyrometer. Substantially similar results were achieved as in Example I.

Although the invention has been described with preferred embodiments it is to be understood that variations and modifications may be employed without departing from the concept of the invention as defined in the following claims.

We claim:

1. In a process for the thermal stabilization of an acrylic fibrous material selected from the group consisting of an acrylonitrile homopolymer and an acrylonitrile copolymer containing at least 85 mole percent acrylonitrile units and up to 15 mole percent of one or more monovinyl units copolymerized therewith wherein said acrylic fibrous material is heated in an oxygen-containing atmosphere while retaining the original fibrous configuration substantially intact and said acrylic fibrous material is rendered black in appearance and non-burning when subjected to an ordinary match flame; the improvement of accomplishing at least a portion of the heating of said acrylic fibrous material by the intermittent irradiation of said acrylic fibrous material with a laser beam.

2. A process for the thermal stabilization of an acrylic fibrous material according to claim 1 wherein said acrylic fibrous material is selected from the group consisting of an acrylonitrile homopolymer and an acrylonitrile copolymer containing at least 95 mole percent of acrylonitrile units and up to 5 mole percent of one or more monovinyl units copolymerized therewith.

3. A process for the thermal stabilization of an acrylic fibrous material according to claim 1 wherein said acrylic fibrous material is provided as a continuous length of multifilamentary material.

4. A process for the thermal stabilization of an acrylic fibrous material according to claim 1 wherein said acrylic fibrous material is heated to a time average temperature determined by optical pyrometry of approximately 200° to 250° C. while being intermittently irradiated with said laser beam.

5. A process for the thermal stabilization of an acrylic fibrous material according to claim 1 wherein said intermittent irradiation with a laser beam is produced by a $CO_2$ infrared laser.

6. A process for the thermal stabilization of an acrylic fibrous material according to claim 1 wherein said intermittent irradiation is produced by pulsing said laser beam.

7. A process for the thermal stabilization of an acrylic fibrous material according to claim 1 wherein said intermittent irradiation is produced by the relative movement of said laser beam and said acrylic fibrous material.

8. A process for the thermal stabilization of an acrylic fibrous material according to claim 1 wherein said heating of said acrylic fibrous material above ambient temperature is accomplished solely by intermittent irradiation with a laser beam.

9. In a process for the thermal stabilization of an acrylic fibrous material selected from the group consisting of an acrylonitrile homopolymer and an acrylonitrile copolymer containing at least 95 mole percent acrylonitrile units and up to 5 mole percent of one or more monovinyl units copolymerized therewith wherein said acrylic fibrous material is heated in an oxygen-containing atmosphere while retaining the original fibrous configuration substantially intact and said acrylic fibrous material is rendered black in appearance and non-burning when subjected to an ordinary match flame; the improvement of accomplishing the heating of said acrylic fibrous material by the intermittent irradiation of said acrylic fibrous material with a $CO_2$ infrared laser beam whereby said acrylic fibrous material is heated to a time average temperature determined by optical pyrometry of approximately 200° to 250° C.

10. A process for the thermal stabilization of an acrylic fibrous material according to claim 9 wherein said acrylic fibrous material is provided as a continuous length of multifilamentary material.

11. A process for the thermal stabilization of an acrylic fibrous material according to claim 9 wherein said continuous length of multifilamentary material is continuously passed in the direction of its length while under a constant tension through said $CO_2$ infrared laser beam.

12. A process for the thermal stabilization of an acrylic fibrous material according to claim 9 wherein said acrylic fibrous material possesses a denier per filament of approximately 0.5 to 1.6 prior to said thermal stabilization, and said acrylic fibrous material is subjected to said intermittent irradiation with said $CO_2$ infrared laser beam for approximately 5 to 20 minutes.

13. A process for the thermal stabilization of an acrylic fibrous material according to claim 9 wherein said intermittent irradiation is produced by pulsing said laser beam.

14. A process for the thermal stabilizaiton of an acrylic fibrous material according to claim 9 wherein said intermittent irradiation is produced by the relative movement of said laser beam and said acrylic fibrous material.

15. In a process for the thermal stabilization of an acrylic fibrous material having a denier per filament of approximately 0.5 to 1.6 selected from the group consisting of an acrylonitrile homopolymer and an acrylonitrile copolymer containing at least 95 mole percent acrylonitrile units and up to 5 mole percent of one or more monovinyl units copolymerized therewith wherein said acrylic fibrous material is heated in an oxygen-containing atmosphere while retaining the original fibrous configuration substantially intact and said acrylic fibrous material is rendered black in appearance and non-burning when subjected to an ordinary match flame; the improvement of accomplishing the heating of said acrylic fibrous material by the intermittent irradiation of said acrylic fibrous material for approximately 5 to 20 minutes with a $CO_2$ infrared laser beam whereby said acrylic fibrous material is heated to a time average temperature determined by optical pyrometry of approximately 200° to 250° C.

16. A process for the thermal stabilization of an acrylic fibrous material according to claim 15 wherein said acrylic fibrous material is provided as a continuous length of multifilamentary material.

17. A process for the thermal stabilization of an acrylic fibrous material according to claim 16 wherein said continuous length of multifilamentary material is continuously passed in the direction of its length while under a constant tension through said laser beam.

18. A process for the thermal stabilization of an acrylic fibrous material according to claim 15 wherein said intermittent irradiation is produced by pulsing said laser beam.

19. A process for the thermal stabilization of an acrylic fibrous material according to claim 15 wherein said intermittent irradiation is produced by the relative movement of said laser beam and said acrylic fibrous material.

20. A process for the thermal stabilization of an acrylic fibrous material according to claim 19 wherein said intermittent irradiation is produced by the movement of said laser beam in a Lissajous figure.

21. A process for the thermal stabilization of an acrylic fibrous material according to claim 17 wherein the resulting thermally stabilized acrylic fibrous material continuously is passed directly from the zone in which thermal stabilization is accomplished to a carbonization zone.

* * * * *